United States Patent [19]

Hartouni

[11] 4,414,906

[45] Nov. 15, 1983

[54] FUEL CARTRIDGE AND BURNER

[75] Inventor: Edward Hartouni, Claremont, Calif.

[73] Assignee: General Dynamics, Pomona Division, Pomona, Calif.

[21] Appl. No.: 295,204

[22] Filed: Aug. 24, 1981

[51] Int. Cl.[3] ..... F23K 3/00

[52] U.S. Cl. ..... 110/293; 44/38; 110/102; 110/243; 110/251; 110/263; 126/25 B

[58] Field of Search ..... 44/14, 38, 40; 110/341, 110/349, 248, 251, 239, 223, 102, 293, 263; 126/25 B

[56] References Cited

U.S. PATENT DOCUMENTS

| | | | |
|---|---|---|---|
| 752,389 | 2/1904 | Engels | 126/73 |
| 779,467 | 1/1905 | Cravath | 110/293 |
| 1,163,978 | 12/1915 | Devlin | 126/107 |
| 1,392,071 | 9/1921 | Moranville | 126/107 |
| 1,501,847 | 7/1924 | Howell | 110/294 |
| 1,916,573 | 7/1933 | Jessen | 44/38 |
| 1,983,059 | 12/1934 | Zimmerman | 110/293 |
| 2,039,423 | 5/1936 | Johnson et al. | 110/293 |
| 2,151,516 | 3/1939 | Johnson | 122/30 |
| 2,155,120 | 4/1939 | Fellows | 110/293 |
| 2,170,326 | 8/1939 | Headland | 126/25 B |
| 2,374,808 | 5/1945 | Edwards | 110/293 |
| 2,454,400 | 11/1948 | Norman | 126/110 R |
| 2,481,165 | 9/1949 | Landry | 126/76 |
| 2,540,278 | 2/1951 | Molotzak | 126/25 B |
| 4,007,696 | 2/1977 | Robertson | 110/293 |
| 4,102,279 | 7/1978 | Groschl | 110/234 |
| 4,243,393 | 1/1981 | Christian | 44/14 |
| 4,278,034 | 7/1981 | Reale | 110/251 |

*Primary Examiner*—Edward G. Favors
*Assistant Examiner*—Steven E. Warner
*Attorney, Agent, or Firm*—Neil F. Martin; John R. Lindsay; Edward B. Johnson

[57] ABSTRACT

A burner casing having a vertical support sleeve mounted at its center forms a combustion chamber below the sleeve and an annular duct space that surrounds the sleeve. A self supporting fuel cartridge containing consolidated solid fuel particles fits slidably within the support sleeve and has one end resting upon a mandrel located in the combustion chamber. Air to support steady state combustion of the fuel particles at a surface of the cartridge is forced downwardly through the cartridge. The heat of combustion and exhaust products pass from the combustion chamber through the annular duct space and then to other furnace components.

2 Claims, 6 Drawing Figures

FUEL CARTRIDGE AND BURNER

BACKGROUND OF THE INVENTION

The scarcity and cost of oil and gas for use in home heating plants has drastically affected the continued use of such fuel. The availability of coal as a fuel compels its consideration as a source for domestic heating purposes, particularly if the inherent disadvantages of its use such as the difficulty in storage and handling, the polluting products of coal combustion, and the disposal of solid waste products of combustion can be overcome or minimized.

The conventional hopper-fed automatically stoked home furnace, with air to support combustion at or below the coal bed, is subject to all of the major disadvantages mentioned. Loose coal must be stored and loaded into the hopper with the attendant handling problems and dust. Combustion of coal in a typical domestic furnace is characterized by changing conditions in the fuel bed. The stoker feeds coal by auger and is cycled on and off by a thermostat control. When the stoker is on, coal is fed at a constant rate into a furnace retort that is supplied with air by a blower. Temperature in the fuel bed rises gradually, increasing the rate of heat release. The temperature of the fuel bed generally does not reach a steady state before the thermostat stops the fuel feed and blower. Upon shut-down of the latter elements, the fuel bed continues to burn at a slow rate which is limited by the natural draft air supply of the furnace. Because the combustion reaction is limited by air supply, combustion is not complete during this cool down period leading to the formation of hydrocarbons, carbon monoxide and soot in the exhaust. Since ash is dropped through the grate and from the sides of the bed into relatively cool regions, periodic cool down is necessary to prevent the ash from agglomerating into chunks too large to be removed. As a result, even when an underfeed stoker is operated at full load, ash disposal makes it necessary to shut down periodically to allow the ash to cool and fuse to avoid the formation of large clinkers. To maintain ignition in no load operation, the fuel bed must be fired briefly at intervals.

It is desirable, therefore, to provide a solid fuel burning arrangement in which the fuel is made available in a consolidated prepared form to eliminate the difficulty and dirt associated with the handling of loose coal. Since much of the pollutant formation in domesite stoker furnaces is the result of transient phenomena in the fuel bed, it is desirable to provide a burner which burns the fuel in a steady manner to permit more complete combustion and improve the quality of furnace emissions. Fuel additives tailored to improve performance and reduce pollutants are also desirable. Combustion arrangements that provide continuous ash removal thus eliminating periodic cooldowns, and which allow all of the fuel to be burned would also improve emissions. These and additional desirable features are achieved by the fuel cartridge and burner disclosed herein.

SUMMARY OF THE INVENTION

According to the invention, a self contained prepared fuel cartridge containing burnable fuel particles replaces the usual fuel source configuration of the conventionally designed domestic furnace.

In the exemplary embodiment, the cartridge is formed as an elongated cylinder of consolidated fuel particles. The cartridge is supported vertically within the furnace burner in a support sleeve with its lower end resting on a mandrel positioned below the sleeve in the combustion chamber of the burner. The cylinder is designed to be ignited and progressively burned by steady state combustion of the fuel particles at a selected surface of the cylinder. Several methods of achieving such combustion are possible, and two ways are illustrated in the exemplary embodiments.

In one embodiment, the cylindrical cartridge is slidably mounted in the cartridge support sleeve. In this design the selected combustion surface is the lower end of the cartridge which rests upon a mandrel spaced below the sleeve. Air is forced through the interstices of the consolidated fuel particles from the opposite end of the cartridge, and supports combustion of the lower cartridge surface in the combustion chamber surrounding the mandrel. As the surface particles are consumed, ash falls to a space below the mandrel and the cartridge slides downwardly to provide additional fuel to be burned.

In a second exemplary design, the cartridge has a central hollow core to which air is supplied. In this design, the fuel particles at the core surface are ignited, and the cartridge burns from this interior surface to its outer periphery. In both of the above instances the downward draft of air permits more complete combustion, and causes any volatile products produced by preheating of the cartridge to flow to the combustion chamber for burning. These factors tend to lessen the pollutants contained within the furnace emissions.

Easily burnable material applied at the combustion surface aids in cartridge ignition. Chemical additives to lessen undesirable combustion products or improve burning may be included as constituents in the prepared fuel cartridge.

It is therefore an object of the invention to provide a new and improved prepared solid fuel cartridge and burner. The fuel cartridge of the invention permits control of particle size and distribution in order to optimize the furnace design. The fuel cartridge and burner of the invention permits lower emissions of tar, carbon monoxide and fly ash from the furnace. It is capable of steady state operation for extended periods of time which further enhances control of pollutants. The fuel cartridge does not require a grating at the combustion surface which facilitates ash removal. The burner is simple in design, and may be economically constructed. Additives or treated fuels may be included in the cartridge to further improve emission control.

Other objects and advantages of the invention will become more apparent upon reading the following detailed description together with the drawings, in which like reference numerals refer to like parts throughout and in which.

DETAILED DESCRIPTION OF THE DRAWINGS

Figure 1:
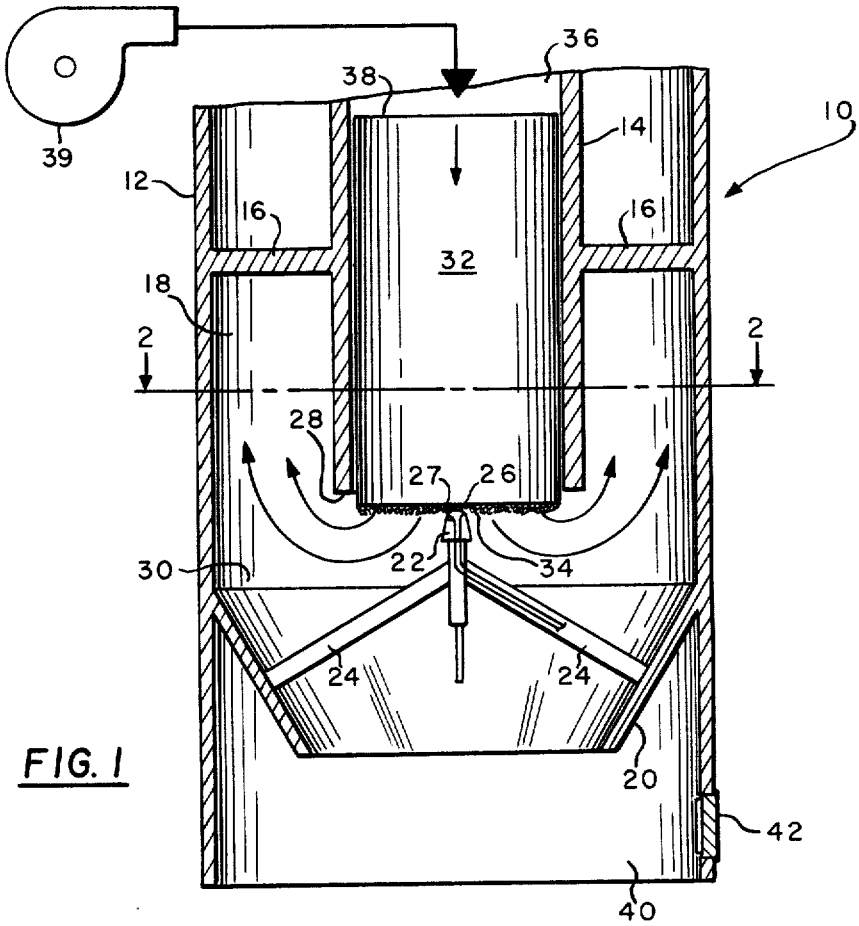
FIG. 1 is a vertical cross sectional view of the fuel cartridge and burner.
Figure 2:
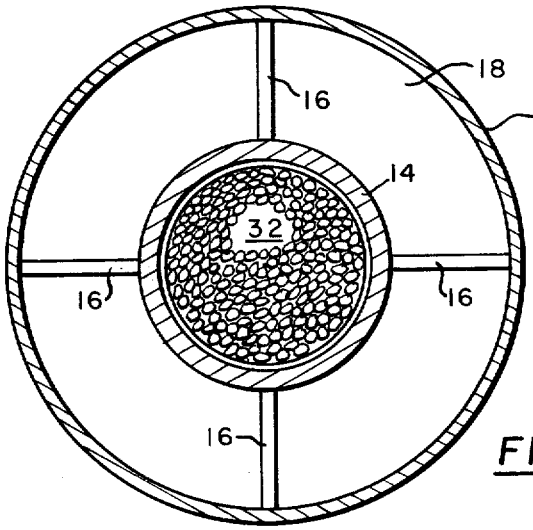
FIG. 2 is a horizontal cross sectional view of the cartridge and burner along lines 2—2 of FIG. 1.

The configuration of the fuel cartridge burner 10 is illustrated in FIGS. 1 and 2. It is formed as an elongated cylindrical unit having an outer casing 12 which encloses and supports the elements of the burner 10. A hollow cylindrical cartridge support sleeve 14 made from refractory material is mounted within casing 12 and supported by sleeve support members 16. As indicated in FIG. 2, the connections of sleeve supports 16 to the casing 12 are spaced apart so as to cause minimal interference with the annular passage 18 formed between sleeve 14 and casing 12.

An ash deflector 20, having the shape of an inverted hollow cone frustum, open at both ends, is mounted within the casing 12 below the cartridge sleeve 14. Mandrel 22 is supported in deflector 20 by mandrel struts 24 such that the upper surface of the mandrel 26 lies in the plane of the lower end 28 of the cartridge support sleeve 14.

The space within casing 12 and below the lower end 28 of support sleeve 14 forms the combustion chamber 30 of burner 10. Chamber 30 is in direct communication with annular passage 18.

The fuel cartridge 32 is supported with a sliding fit within support sleeve 14 and has its combustion surface 34 resting upon the upper surface 26 of mandrel 22. An electric calorific element 27 adjacent to surface 26 serves to ignite the cartridge. The electrical supply to element 27 is not illustrated. Air to support the combustion of the fuel cartridge 32 at its combustion surface 34 is supplied to the interior 36 of the support sleeve 14 above the upper surface 38 of the fuel cartridge. In the embodiment illustrated, air is forced through fuel particle interstices of the cartridge to its combustion surface 34 by a blower 39 or other suitable means.

The heat and exhaust products formed in the combustion chamber 30 pass upward through the annular passage 18 to a heat exchanger and furnace exhaust emission system not shown in the drawings. Ash formed at the combustion surface 34 drops through ash deflector 20 and falls to the ash pit 40. Use of mandrel 22 instead of a grating at the combustion surface of cartridge 32 avoids the difficulty of maintaining ash free operation at the combustion surface. Access door 42 adjacent to the base of outer casing 12 permits periodic removal of the accumulated ash.

Figure 3A:
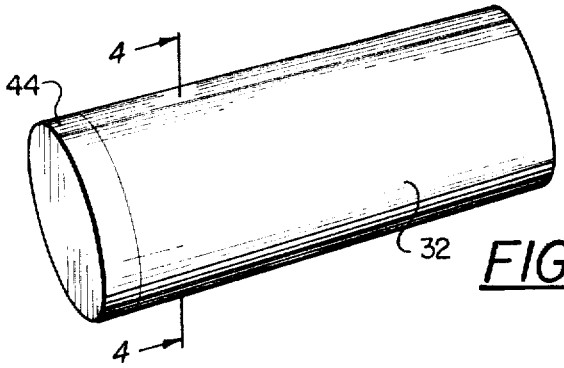
FIG. 3A is a perspective view of one embodiment of the fuel cartridge.
Figure 3B:
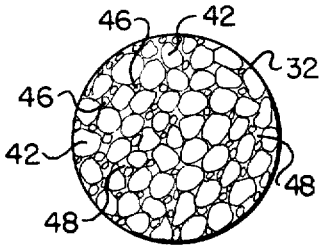
FIG. 3B is a cross sectional view of the cartridge illustrated in FIG. 3A along line 4—4 of FIG. 3A.

This embodiment of the fuel cell 32 is illustrated in FIGS. 3A and 3B. The cartridge 32 is an elongated cylinder formed by compacting fuel particles 42 of controlled size into the desired shape after they have been coated with a binder material. In FIG. 3A fuel cartridge 32 is provided with an ignition layer 44 formed of wax, or other easily burnable materials, to assist in starting the combustion of the cartridge 32. Additives, represented by particles 46 may be included in the prepared cartridge 32 both for improved combustion and for control of pollutants. The addition of calcium, for example, would absorb sulfur dioxide formed by the burning of the coal particles. The interstices 48 between particles 42 and 46 permit the flow of air for combustion through the cartridge 32. Other compaction configurations for the fuel particles 42 may be employed such as honeycomb frame or sponge structures formed from binding material and having air passage interstices. The binding materials used in compacting the fuel particles 42 may also serve as ignition material.

Figure 4A:
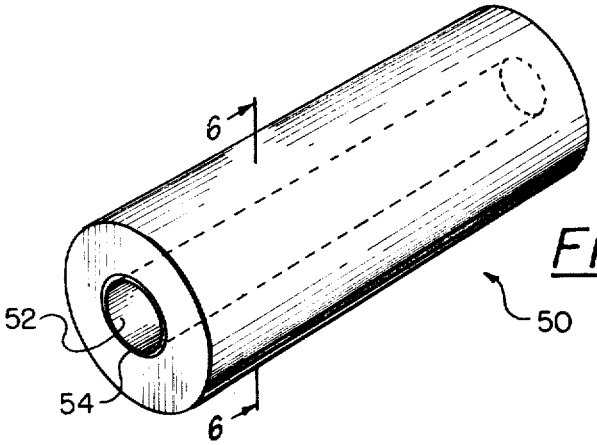
FIG. 4A is a perspective view of a second embodiment of the fuel cartridge.
Figure 4B:
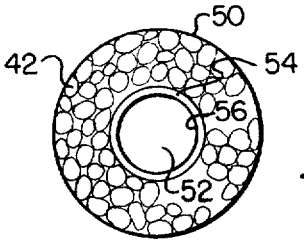
FIG. 4B is a cross sectional view of the cartridge illustrated in FIG. 4A along line 6—6 of FIG. 4A.

FIGS. 4A and 4B illustrate a second embodiment 50 of the fuel cartridge. In this design fuel cartridge 50 is compacted in the form of an elongated cylinder having a central hollow core 52 provided with a layer 54 of ignition material. With cartridge 50, combustion of the fuel particles 42 is initiated at the surface 56 of the ignition material 54.

OPERATION

Referring to FIG. 1, the burner 10 is loaded by lowering fuel cartridge 32, ignition layer 44 first, into the cartridge support sleeve 14 until the combustion surface 34 rests on mandrel 22. The ignition layer 44 is then ignited. As the fuel particles 42 are consumed, the ash is allowed to drop through deflector 20 to the ash pit 40. Since all of the combustion air passes through the cartridge, the air and products of combustion are well mixed leading to a more complete combustion of the fuel. The burning of the fuel cartridge 32 is designed to continue at a combustion surface 34 under steady combustion conditions. Analysis of the combustion of fuel cartridges indicates that such cartridges have acceptable combustion rates, such that a cartridge having a 30 cm diameter is able to produce a total heat of combustion in the range of 40,000 Btu/hour with a combustion temperature of 1000 degrees Kelvin over a 4 hour period. Heat generated by the steady state combustion of the fuel cartridge in excess of the current house heating needs may be stored for later use by various means, as by heating water in a recirculating system. Shutdown can be accomplished by securing the air to burner 10, or allowing the cartridge to be entirely consumed.

Having described my invention, I now claim:

1. A solid fuel cartridge and burner comprising:

a vertically oriented burner casing for mounting in a furnace, a hollow cylindrical support sleeve mountable concentrically within and spaced from the burner casing to form a combustion gas passage therebetween for transferring the gaseous combustion products of said burner to other furnace components, a self-supportable fuel element mountable in the support sleeve with a close but slideable fit, the fuel element being formed of consolidated solid fuel particles and having a selected combustion surface, a mandrel positionable in the center of the casing and spaced below the support sleeve upon which the lower end of the fuel element rests, a combustion chamber surrounding the mandrel formed by the burner casing and in communication with the combustion gas passage, pressure generating means for supplying air under pressure to the fuel element at its end opposite the mandrel for combustion of the fuel particles at the selected combustion surface and in the combustion chamber, the fuel element including intersticial spaces between the consolidated fuel particles for permitting the passage of air for combustion through the fuel element to the selected combustion surface, and means contained within the mandrel for igniting the fuel particles at the combustion surface.

2. A solid fuel cartridge and burner comprising:

a vertically oriented burner casing for mounting in a furnace, a hollow cylindrical support sleeve mountable concentrically within and spaced from the burner casing to form a combustion gas passage therebetween for transferring the gaseous combustion products of said burner to other furnace components, a self-supportable fuel element mountable in the support sleeve with a close but slideable fit, the fuel element being formed of consolidated solid fuel particles and having a selected combustion surface, a mandrel positionable in the center of the casing and spaced below the support sleeve upon which the lower end of the fuel element rests, a combustion chamber surrounding the mandrel formed by the burner casing and in communication with the combustion gas passage, pressure generating means for supplying air under pressure to the fuel element at its end opposite the mandrel for combustion of the fuel particles, air channel means formed in the fuel element for both transmitting the air for combustion and providing the selected combustion surface, and means contained within the mandrel for igniting the fuel particles at the combustion surface.

* * * * *